US008939605B2

(12) United States Patent
Snijder et al.

(10) Patent No.: US 8,939,605 B2
(45) Date of Patent: Jan. 27, 2015

(54) CONTROLLABLE LIGHTING SYSTEM

(75) Inventors: Pieter Jacob Snijder, Valkenswaard (NL); Winfried Antonius Henricus Berkvens, Sint-Oedenrode (NL); Hugo Johan Cornelissen, Waalre (NL); Pierre Robert Valère Sonneville, Weert (NL)

(73) Assignee: Koninklijke Philips N.V., Eindhoven (NL)

( * ) Notice: Subject to any disclaimer, the term of this patent is extended or adjusted under 35 U.S.C. 154(b) by 201 days.

(21) Appl. No.: 13/386,479

(22) PCT Filed: Jul. 14, 2010

(86) PCT No.: PCT/IB2010/053213

§ 371 (c)(1),
(2), (4) Date: Jan. 23, 2012

(87) PCT Pub. No.: WO2011/010247

PCT Pub. Date: Jan. 27, 2011

(65) Prior Publication Data

US 2012/0119657 A1 May 17, 2012

(30) Foreign Application Priority Data

Jul. 24, 2009 (EP) ..... 09166296

(51) Int. Cl.

| | |
|---|---|
| ***F21V 11/00*** | (2006.01) |
| ***H05B 33/08*** | (2006.01) |
| ***F21V 5/04*** | (2006.01) |
| *F21V 5/00* | (2006.01) |
| *F21Y 105/00* | (2006.01) |

(Continued)

(52) U.S. Cl.

CPC ..... *H05B 33/0803* (2013.01); *F21V 5/04* (2013.01); *F21V 5/002* (2013.01); *F21Y 2105/001* (2013.01); *F21V 5/001* (2013.01); *F21V 23/0464* (2013.01); *F21Y 2101/02* (2013.01)

USPC ..... 362/235; 362/245; 362/297

(58) Field of Classification Search

USPC ..... 362/235, 217, 245, 297, 308, 287

See application file for complete search history.

(56) References Cited

U.S. PATENT DOCUMENTS

| | | | |
|---|---|---|---|
| 6,988,815 | B1 | 1/2006 | Rizkin et al. |
| 7,314,289 | B2 | 1/2008 | Montagne |
| 7,468,832 | B2 | 12/2008 | Rothenberg et al. |

(Continued)

FOREIGN PATENT DOCUMENTS

| | | | |
|---|---|---|---|
| WO | 2006059265 | A1 | 6/2006 |
| WO | 2007066112 | A1 | 6/2007 |

(Continued)

*Primary Examiner* — Jason M Crawford

(74) *Attorney, Agent, or Firm* — Yuliya Mathis

(57) ABSTRACT

A lighting system comprising a plurality of controllable light emitting elements 3 is disclosed. The lighting system further comprising a spreading optical element 5 arranged in front of the plurality of light emitting elements to shape the light emitted from the lighting elements, and a controller 7 for varying a light emission angle range of light emitted from the spreading optical element 5 by controlling each of the plurality of controllable light emitting elements. This allows the light emitted from the spreading optical element to be varied without varying any physical parts of the lighting system, because the controller now controls each of the light emitting elements, by e.g. dimming one or more of the light emitting elements or by switching one or more of the light emitting elements off.

14 Claims, 7 Drawing Sheets

(51) Int. Cl.
*F21V 23/04* (2006.01)
*F21Y 101/02* (2006.01)

(56) References Cited

U.S. PATENT DOCUMENTS

| | | | | |
|---|---|---|---|---|
| 2002/0006040 | A1 | 1/2002 | Kamada et al. | |
| 2005/0174775 | A1* | 8/2005 | Conner | 362/268 |
| 2006/0139933 | A1 | 6/2006 | Lin et al. | |
| 2006/0152931 | A1* | 7/2006 | Holman | 362/297 |
| 2007/0263388 | A1* | 11/2007 | Lai et al. | 362/287 |
| 2008/0062706 | A1* | 3/2008 | Feldmeier | 362/459 |
| 2008/0247024 | A1 | 10/2008 | Jurik | |
| 2008/0253129 | A1 | 10/2008 | Lin et al. | |
| 2009/0303417 | A1* | 12/2009 | Mizushima et al. | 349/65 |
| 2010/0014022 | A1* | 1/2010 | Nagata et al. | 349/62 |
| 2010/0096993 | A1* | 4/2010 | Ashdown et al. | 315/113 |
| 2010/0220261 | A1* | 9/2010 | Mizushima et al. | 349/64 |

FOREIGN PATENT DOCUMENTS

| | | | |
|---|---|---|---|
| WO | 2008152561 | A1 | 12/2008 |
| WO | 2009031103 | A1 | 3/2009 |

* cited by examiner

CONTROLLABLE LIGHTING SYSTEM

FIELD OF THE INVENTION

The present invention relates to a controllable lighting system.

BACKGROUND OF THE INVENTION

Lighting systems are widely used to create ambiance in homes. The systems create light patterns that create atmospheres.

WO 2009/031103 describes a multi color light source emitting light beams of different colors. The multi color light sources can be used in applications in which highly concentrated full spectrum light is required. Examples of such applications are spot lighting and digital projection. In this way the color of e.g. the spot lighting can be varied. But a problem with this arrangement is that in order to achieve a moving light pattern the light source needs to be moved by e.g. a mechanical arrangement. As a consequence of that, such systems are often not thin and compact but relatively thick and bulky.

SUMMARY OF THE INVENTION

It is an object of the present invention to overcome these problems, and to provide a lighting system that can create a changeable lighting pattern and that is thin and compact.

This object is fulfilled by a lighting system comprising a plurality of controllable light emitting elements, a spreading optical element arranged in front of the plurality of light emitting elements to shape the light emitted from the lighting elements, and a controller for varying a light emission angle range of light emitted from the spreading optical element by controlling each of the plurality of controllable light emitting elements.

The spreading optical element defines an available angular emission range, within which all light emitted by the system will be contained. The control of the light emitting elements then effects a selection of an angular subrange of this available range. By controlling the selection of this subrange the resulting illumination pattern can be varied. This allows the light emitted from the spreading optical element to be varied without varying any physical parts of the lighting system, because the controller now controls each of the light emitting elements, by e.g. dimming one or more of the light emitting elements or by switching one or more of the light emitting elements off. In this way it is e.g. possible to scan light beams, change beam size and shape, since the spreading optical element can convert light emitted from a cluster of light emitting elements into one beam. By changing the position and/or size of the cluster of light emitting elements it is possible to change the location and/or size of the spots.

The emission angle range may further be divided into several separate subranges, by activating several separate clusters of light emitting elements. The illumination pattern may thereby comprise several spots.

The controller may further be adapted to vary at least one of illumination gradient and color gradient of light emitted from the spreading optical element.

In an embodiment, the lighting system comprises a plurality of individually collimated light sources, each comprising a plurality of said controllable light emitting elements and a beam collimating optics. In this way a number of narrow beams are obtained. For example each collimated light source may include a red, a blue, and a green light emitting element. Thus it is possible to determine the color output of the light.

The plurality of the collimated light sources can e.g. be arranged in a two dimensional array. Accordingly it is e.g. possible to provide a spot that can be moved in two directions without any moving optical elements. E.g. the two dimensional array may be a rectangular N×M-array, where N represents the number of rows in the array, and M represents the number of collimated light sources in each row. E.g. N and M each are at least 6.

For example the controller may be programmed to realize a plurality of different light emission patterns by applying a set of preprogrammed control parameters of the controllable light emitting elements. In this way different ambiences can be created. The term light emission pattern should be construed as the light pattern made up of various properties of the light emitted from the spreading optical element e.g. emission angle ranges, colors, and illumination gradient, as well as the dynamics of the emitted light e.g. different pulse patterns.

The lighting system may further comprise a light sensor, such that in use the light sensor measures prescribed light emission angle ranges and the controller compares these with a requested light emission angle ranges. In this manner the light emission ranges can automatically be adjusted to a prescribed light emission range without any user assistance. For example the light sensor and the light emitting elements may be electrically and mechanically integrated in a lighting unit, so that a compact design is achieved. By use of a sensor it is possible to automatically adapt the light pattern, i.e. it is possible to adapt the light pattern without moving the lamp or by input to the lamp. This is an advantage since when a lamp is positioned in a home the position of the lamp may change once in a while unintentionally due to small movements and shifts, which for instance is a result of pushes against the lamp during cleaning, or intentionally. In this way it is e.g. possible to vary the beam angle, shift the beam angle, vary the gradient of illumination, and vary the gradient of color if colored red, green and blue LEDs are used. The lighting system may e.g. comprise an indicator adapted to transmit light information, and wherein the light sensor is adapted to sense the light information transmitted to the light sensor, and transmit this transmitted light information to the controller, the controller being adapted to link the transmitted light information into a light emission pattern. This provides for an easy use of the lighting system.

The spreading optical element may e.g. be a negative or positive lens, a negative or positive Fresnel lens, or a patterned array of micro-prismatic beam deflectors. It is an advantage of the Fresnel lens that it is thin and compact compared to a conventional lens, and besides that it is much easier to manufacture than a patterned array of micro-prismatic beam deflectors. If a positive lens or a positive Fresnel lens is used it provides for longer working distances in order for the light to spread after it has been focused.

It is noted that the invention relates to all possible combinations of features recited in the claims.

BRIEF DESCRIPTION OF THE DRAWINGS

This and other aspects of the present invention will now be described in more detail, with reference to the appended drawings showing a currently preferred embodiment of the invention. Like numbers refer to like features throughout the drawings.

DETAILED DESCRIPTION OF PREFERRED EMBODIMENTS

Figure 1:
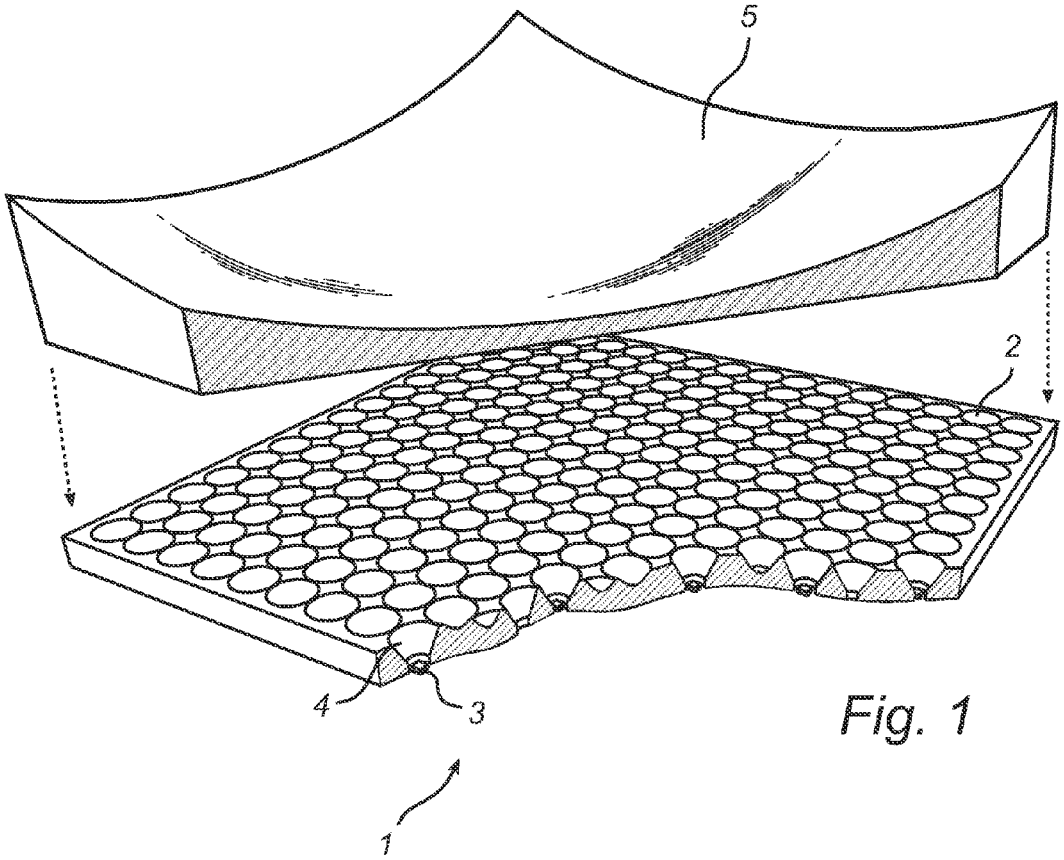
FIG. 1 is a lamp according to an embodiment of the present invention.

The lighting unit in the illustrated example in form of a lamp 1 in FIG. 1 comprises an array of collimated light sources 2 arranged in a two dimensional array wherein the two dimensional array is a rectangular 16×16-array. The collimated light sources 2, each comprises a plurality of the controllable light emitting elements 3 and a beam collimating optics 4, wherein each collimated light source 2 includes a red, a blue, and a green light emitting element 3, preferably in form of a red, a blue and a green Light Emitting Diode (LED) 3. Alternatively each collimated light source 2 may include a red, a blue, a green and a white light emitting element 3. The lamp 1 further comprises a negative lens 5 arranged on top of the collimated light sources 2.

Figure 2:
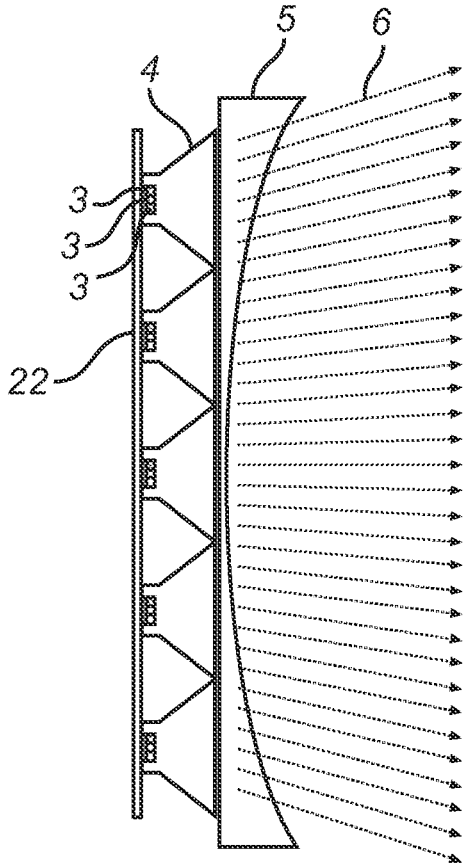
FIG. 2 is a schematic view of a lamp with a negative lens.

FIG. 2 shows a schematic view of a lamp with a negative lens 5. A number of light emitting elements 3 may e.g. be mounted on a Printed Circuit Board (PCB) layer 22. The PCB may e.g. comprise an isolated carrier made of a heat transferring material such as a metal, e.g. aluminum, with a single isolation layer. In the illustrated example the light emitting elements 3 are grouped in a red LED, a blue LED and a green LED, arranged with a beam collimating optics 4 in front of them, in this way an array of collimated light sources 2 is achieved. Alternatively the light emitting elements 3 could be grouped in a red LED, a blue LED, a green LED as well as a white LED, arranged with a beam collimating optics 4 in front of them. A spreading optical element in form of a negative lens 5 is arranged in front of the collimated light sources 2 and thus also the light emitting elements 3. In the illustrated example all the collimated light sources 2 emit light such that the negative lens 5 spread emitted light 6 over the entire emission angle range.

Figure 3:
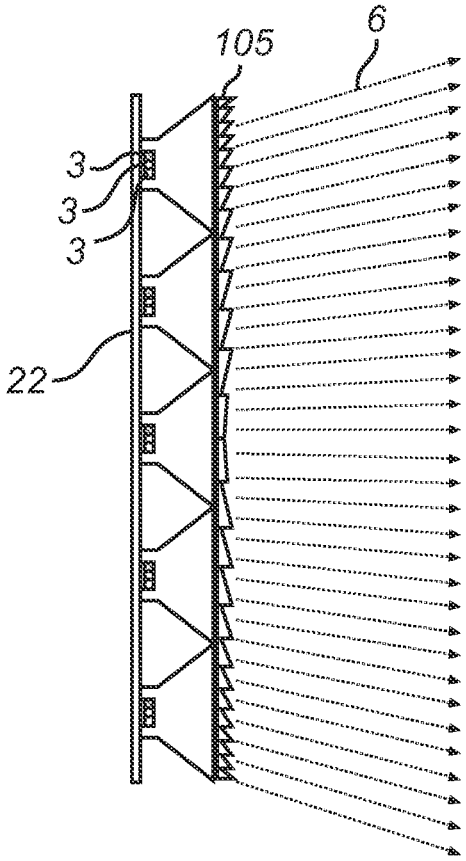
FIG. 3 is a schematic view of a lamp with negative Fresnel lens.

FIG. 3 depicts a schematic view of a lamp with negative Fresnel lens 105. Like in FIG. 2 a number of light emitting elements 3 are typically mounted on a PCB layer 22, but the spreading optical element is in the presently illustrated example a negative Fresnel lens 105. This has the advantage that the design of the lamp is very compact.

Figure 4C:
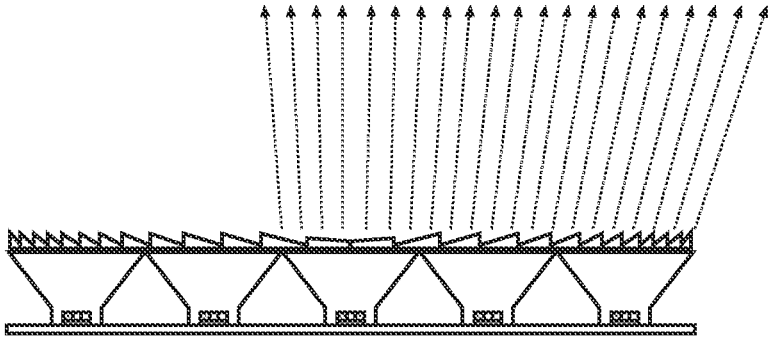
FIG. 4 is a schematic view of a lamp with various beam shapes.
Figure 4B:
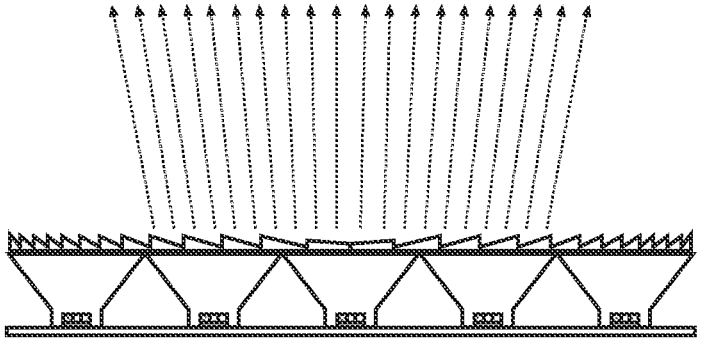
Figure 4A:
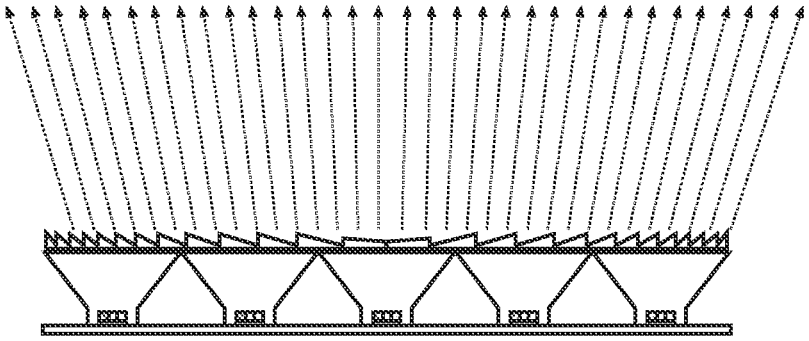

FIG. 4 shows a schematic side view of a lamp with various beam shapes. FIG. 4*a* shows a lamp that emits a light beam with a full emission angle range, and FIG. 4*b* and FIG. 4*c* show a lamp that emits a light beam within a subrange of the full emission angle range. The lamp is able to emit a beam within a subrange of the full emission angle range by emitting light from a cluster of collimated light sources 2. In this way the size and the shape of the spot size of the beam can be varied by varying the number of collimated light sources 2 and the shape of the cluster. Consequently no mechanically moving parts are needed. In the illustrated example in FIG. 4*b* a beam is emitted from the spreading optical element by emitting light from the three collimated light sources in the middle of the lamp. In FIG. 4*c* a beam is emitted from the spreading optical element by emitting light from three collimated light sources 2 from the right side of the lamp. Changing between the two beams (in FIG. 4*b* and FIG. 4*c*) results in that it is conceived as one beam that shifts between two positions.

The intensity of the LEDs may be changed gradually depending on the application, such as in 100 or in 256 steps, e.g. from an off-state to the desired intensity, e.g. a maximum intensity.

Figure 5:
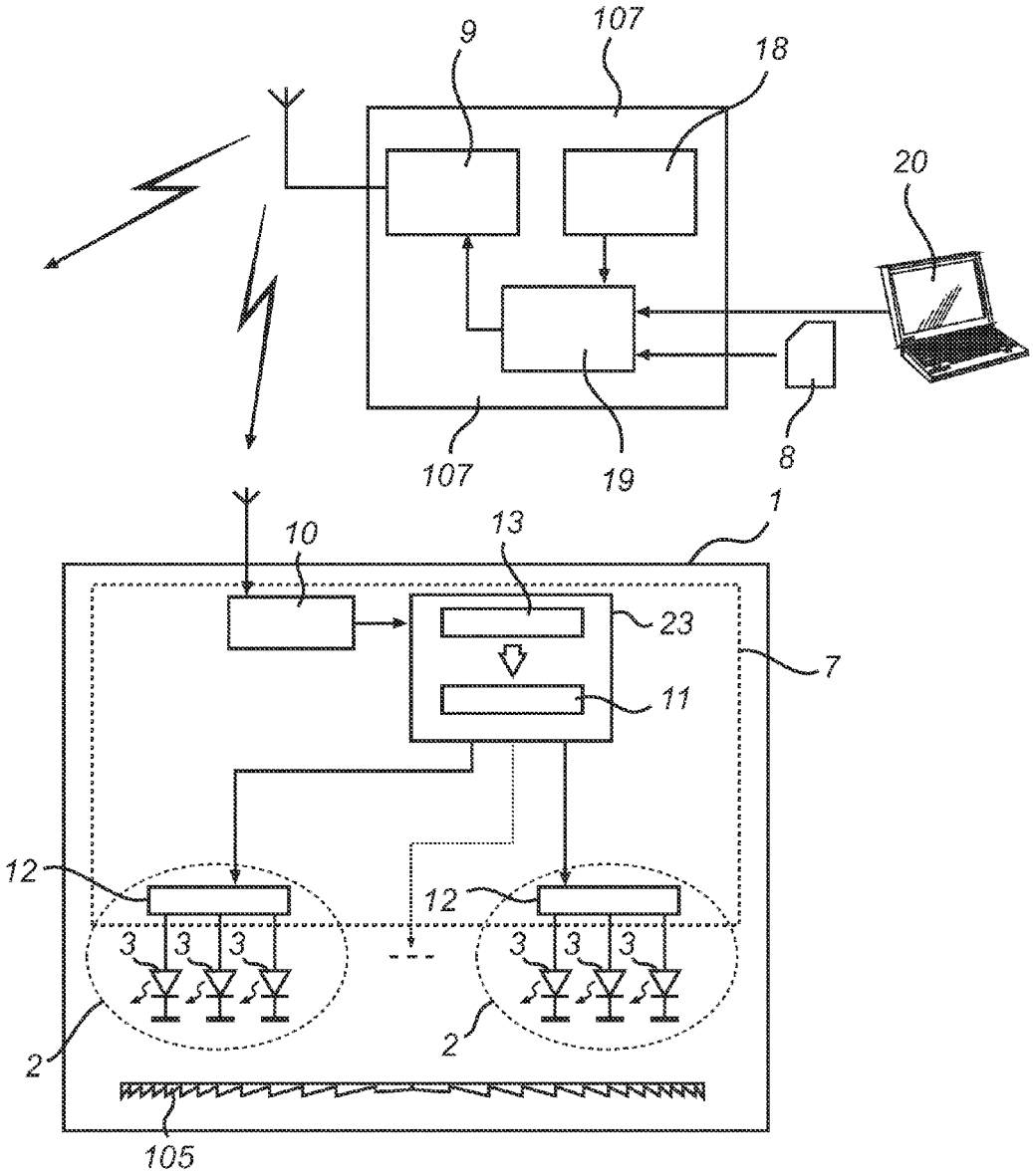
FIG. 5 is a schematic drawing of a lighting system according to an embodiment of the present invention.

FIG. 5 is a schematic drawing of a lighting system according to an embodiment of the present invention, including a lamp 1 and a remote controller 107. In the illustrated example the lamp 1 comprises an N×M array of red, green and blue LEDs sets 2 arranged with 8 bits resolution. Alternatively the LED sets could be arranged with a 10 bits resolution. Each of the LED sets 2 comprises a collimator 4 thereby providing N×M collimated light sources 2. A spreading optical element in form of a negative Fresnel lens 105 is arranged in front of the N×M collimated light sources 2, i.e. in front of the red, green and blue LEDs. In this way the light emitted from the LEDs can be shaped. The lamp 1 further comprises a controller 7 adapted to vary a light emission angle range of light emitted from the Fresnel lens 105, by controlling each of the LEDs 3. The controller 7 comprises a processor 10 and a memory 23 including a shift register 13 with a 3×N×M length and a Latch with a 3×N×M length. The controller 7 further comprises 3×N×M triple Pulse Width Modulation intensity controllers 12.

The remote control unit 107 comprises a power supply 18, a processing unit 19 in communication with a memory card 8 and a personal computer, and a wireless transmitter 9. The remote control unit 107 is programmed to realize a plurality of different light patterns by applying a set of preprogrammed control parameters of the LEDs. The light patterns are stored on the memory card 8. Each light pattern may be linked to an ambience prescription like "summer", "cozy" or "cool". That is, when one of the ambience prescriptions is chosen a corresponding light pattern is emitted by the lamp, such that e.g. a certain color distribution and beam size is emitted. These ambience prescriptions can be chosen by a user by input to the system e.g. via a personal computer 20, which comprises control software. The drive signals for the N×M RGB-LED arrays are mapped by the processing unit 19 in the remote control unit 107.

These drive signals are wirelessly transferred to the lamp 1 from a wireless transmitter 9 in the remote control unit 107 to a wireless receiver and serial interface in the processer 10 in the lamp 1. In another embodiment of the invention the remote control unit 107 is able to communicate with multiple lamps.

In the lamp 1 the signals are first stored in the Shift Register. When the transfer of the drive signals is completed, the information is copied into the Latch 11 and subsequently directed to the Triple Pulse Width Modulation intensity controller 12 drivers of the individual RGB-LEDs. After copying the drive signals to the Latch 11, new drive signals can be received by the Shift Register 13. An advantage of this lay-out is that it is not necessary to provide addressing contacts to all LEDs individually, but that internal storage in the Shift Register 13 and the Latch 11 greatly simplifies the connections to the remote control unit 107. Another advantage is that the changes in drive signals and thus the lighting patterns occur at a well-defined moment and in a well-defined manner when the signals are transferred from the Shift Register 13 to the Latch 11. This transfer happens very fast and reliably, compared to slow and error-prone wireless transfer. In this way the controller 7 is adapted to vary the emission angle range of light emitted from the spreading optical element, by controlling each of the LEDs 3.

In an alternative embodiment of the invention the functionality of the remote controller 107 is integrated in the controller 7.

Figure 6:
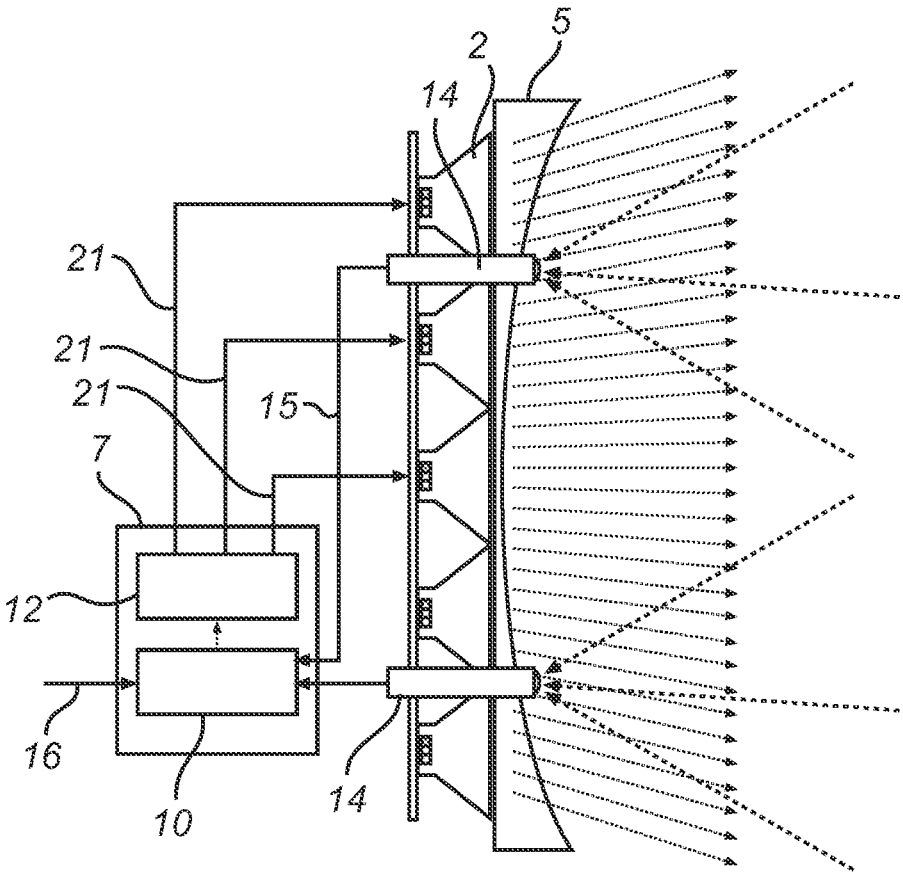
FIG. 6 is a schematic view of an integrated lamp with sensors.

FIG. 6 is a schematic view of an integrated lamp with at least one light sensor 14. In the illustrated example the lamp is provided with a number of light sensors 14 providing feedback 15 to a processor 10 of the controller 7. The light sensor 14 measures prescribed light emission angle ranges and the processor 10 compares the feedback 15 with requested light emission angle ranges 16, e.g. received from a user. By input 21 from the processor 10 an LED controller 12 transmits the parameter setting to each collimated light source 2.

The light sensor 14 is adapted to sense the light that has been emitted from the spreading optical element 5, which in the illustrated example is a negative lens, and reflected back to the light sensors 14. Preferably the light emitting elements 3 and the light sensors 14 are electrically and mechanically integrated in a lighting unit e.g. in form of a lamp.

In an embodiment of the invention the light sensors 14 are cameras having a wide angle lens so that the combination of the images of all the cameras will be larger than the maximum spot beam of the lamp. In this way the set of cameras will see the whole surface illuminated by the lamp. The images made by the cameras will be processed, in real time, by the controller 7 and based on the requested illumination pattern; the parameters will be set for each of the LED sets.

Figure 7:
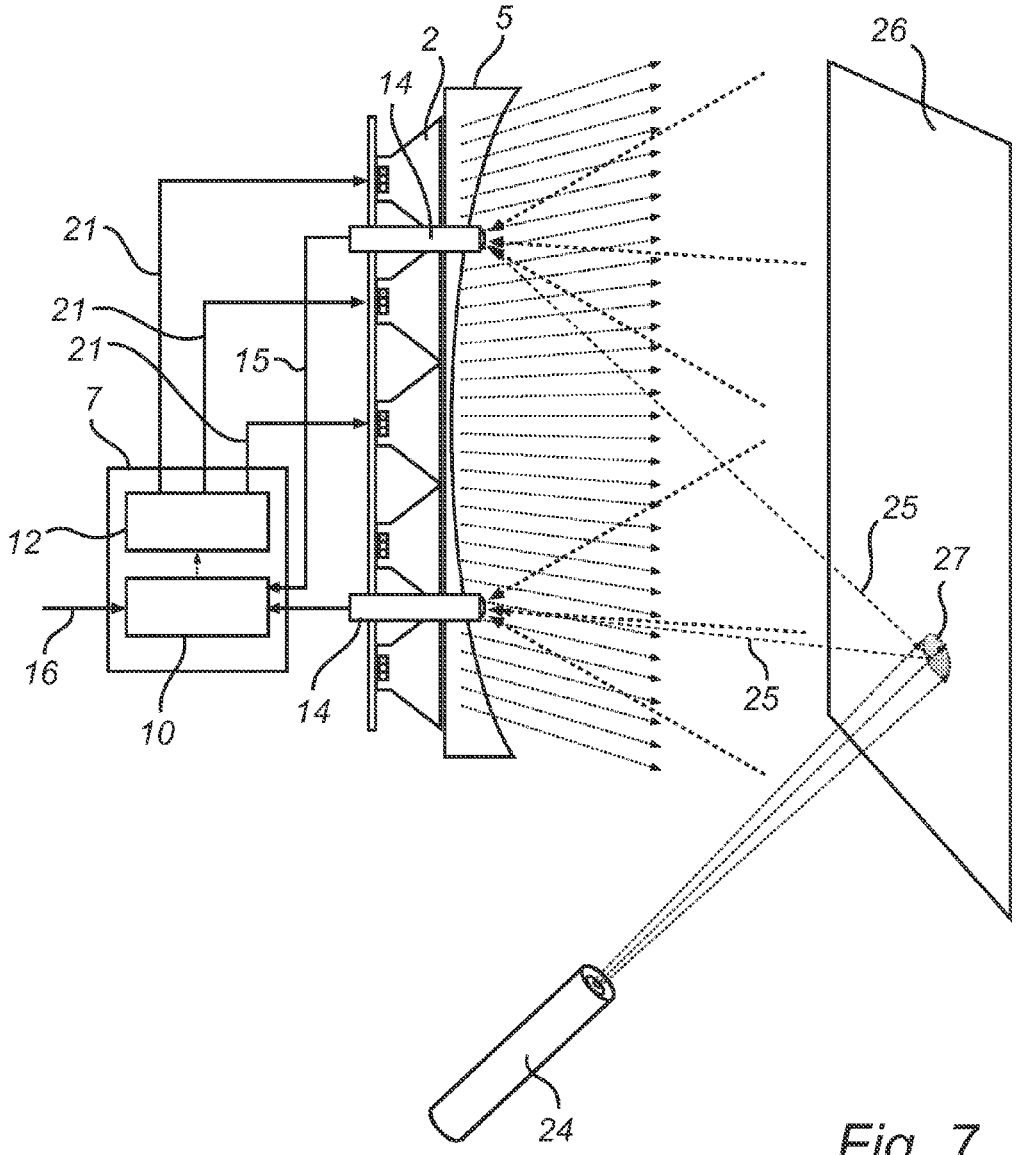
FIG. 7 is a schematic view of an integrated lamp with sensors and an indicator.

FIG. 7 shows a lighting system that comprises an indicator 24, e.g. in form of a laser pointer, adapted to indicate a desired light pattern to the lighting system by emitting light 25 onto a surface 26, to be reflected and then received by the light sensors 14. The light emitted from the indicator may be coded, in order to enable the sensors 14 to distinguish it from other light. The light sensor 14 is adapted to detect the light information 25, and transmit this light information to the controller 7. The controller 7 is adapted to interpret the transmitted light information and to adapt the emitted light so as to provide the desired light pattern.

With the indicator 24 in FIG. 7, a user is able to indicate to the lighting system 1 the shape of the beam to be presented on a surface 26 e.g. a wall. In order to do this, the user uses the indicator 24 to indicate on the surface 26 the area 27 that is to be illuminated. The light sensors 14 detect the light information 25, i.e. the laser's reflection of the wall 26, and use this information to adapt the emitted light pattern. Thus a new light pattern can be requested by the user at any moment in time. So, for instance the user may request to reshape a currently presented shape.

Figure 8:
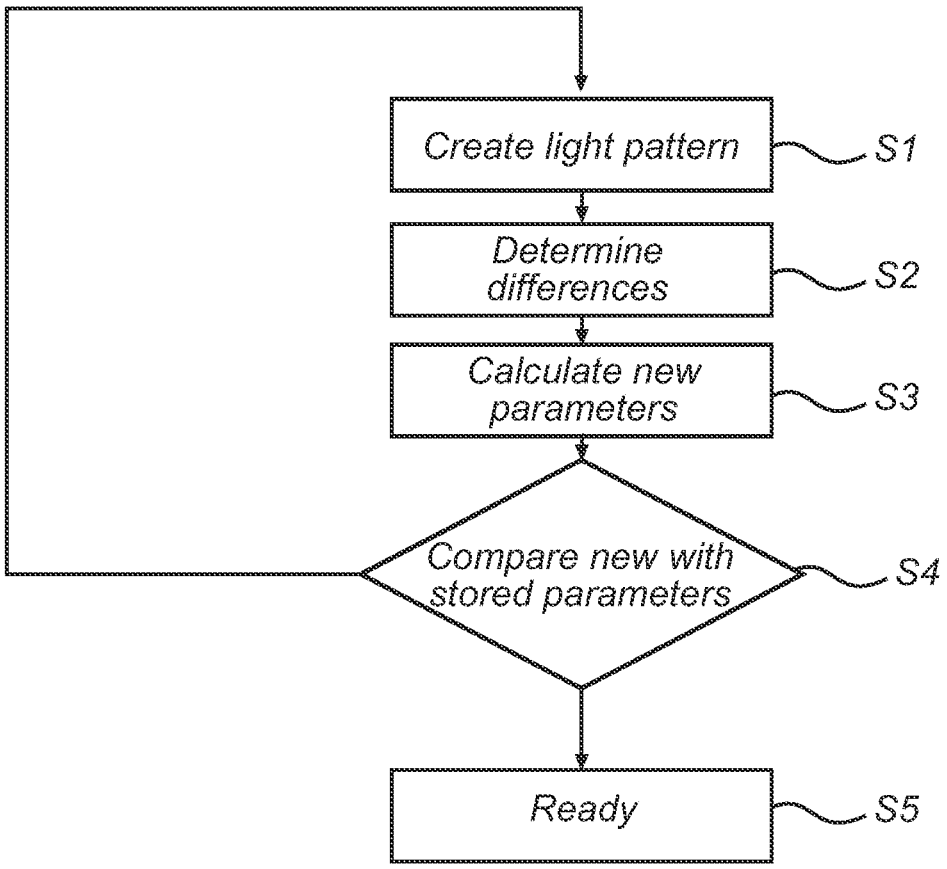
FIG. 8 is a flow chart of the functionality of a controller.

FIG. 8 is a flow diagram of the functionality of the controller 7. The flow diagram illustrates the automatic process of adapting the light pattern, i.e. the emission of light from the lamp.

The controller comprises the following processing steps:

The lamp 1 creates a light pattern based on the requested light pattern, (in the first iteration) using the parameter settings stored from an earlier occasion, or (in the following iterations) using the adapted parameter settings;

Information from the light sensor(s) 14 is used as input to determine the differences between the requested light pattern and the measured light pattern;

The differences are used by the processor 10 to calculate new parameter settings;

The new parameter settings are compared to the parameter settings that are stored in memory. If the new parameter settings are different than the parameter settings calculated during the previous iteration, program control returns to step S1;

If the new parameter settings are not different, the best possible presentation of the requested light pattern has been reached, and the process ends.

The steps S2 and S3, as described in the process steps above, are the most important ones. In these steps it is determined where the mismatches between the requested light pattern and the measured light pattern are and what the new parameter settings have to be.

By extending the above described process it is possible to detect disturbances or inconsistencies in the light pattern on a wall, e.g. a corner in the wall or a plant in front of the wall, etc., and adjust the parameter setting and thereby the illumination, i.e. the light pattern.

Further extensions can be implemented. In another extension the angle that the lamp makes with the surface that is to be illuminated can be determined by scanning this surface, i.e. change the beam direction and measuring the light intensity picked up by the light sensors. The peak light intensity measured together with the direction of the light beam provides information about the angle the lamp makes with the surface to be illuminated.

In another embodiment of the invention the lamp comprises a tilt sensor or the extension as described above. In this way it is possible for the lamp to know the angle under which it emits light e.g. on a wall. This can be done by turning the LED sets on, which, via the spreading optical element (e.g. in form of a Fresnel lens), shine at the wall under an angle of 90 degrees, with fixed Lumen values. Reflections to the light sensor are used to calculate the reflectivity of the wall. This is useful if it is necessary to correct for the spreading optical element in front of the light sensor, e.g. in case a camera is used as a light sensor.

In a further embodiment further light sensors are arranged outside the lamp and the feedback could be a combination of the light sensors inside the lamp and the light sensors outside the lamp. In this way more feedback can be provided and consequently the calculations can be improved.

The person skilled in the art realizes that the present invention by no means is limited to the preferred embodiments described above. On the contrary, many modifications and variations are possible within the scope of the appended claims. For example, the number of light emitting elements and thus also light sources and the number of light sensors may be varied. Also the numbers, N, M, in the rectangular N×M array can be varied, it may e.g. be a 1×2 array or a 12×12 array.

The invention claimed is:

1. A lighting system comprising:

a plurality of controllable light emitting elements, a spreading optical element arranged in front of the plurality of light emitting elements to shape the light emitted from the lighting elements and defining an available angular emission range of light emitted from the spreading optical element, and a controller for controlling drive signals of each of the plurality of controllable light emitting elements, in order to select an angular subrange of the available angular emission range of light emitted from the spreading optical element by selecting the specific light emitting element wherein the controller varies the angular subrange of the available angular emission range of light emitted from the spreading optical element by controlling the light output for a subset of the plurality of controllable light emitting elements thereby modifying an output illumination pattern of the lighting system from a first light output emission angle to a second output emission angle different from the first light output emission angle;

an indicator adapted to indicate a desired light pattern to the lighting system by emitting an indicator light onto a surface being illuminated by the lighting system, the lighting system including a light sensor to detect the indicator light on the surface being illuminated originating from the indicator, wherein the emitted indicator light from the indicator is a coded indicator light;

wherein the controller is in connectivity with the sensor and is operable to adjust the lighting pattern based upon light information from the sensor.

2. The lighting system according to claim 1, wherein the controller is further configured to vary at least one of illumination gradient and color gradient of the light emitted from the spreading optical element.

3. The lighting system according to claim 2, wherein the plurality of the collimated light sources are arranged in a two dimensional array.

4. The lighting system according to claim 3, wherein the two dimensional array is a rectangular N×M-array, where N represents the number of rows in the array, and M represents the number of collimated light sources in each row.

5. The lighting system according to claim 4, wherein N and M each are at least six.

6. The lighting system according to claim 1, comprising a plurality of individually collimated light sources, each comprising a plurality of said controllable light emitting elements and a beam collimating optics.

7. The lighting system according to claim 6, wherein each collimated light source includes a red, a blue, and a green light emitting element.

8. The lighting system according to claim 1, wherein the controller is programmed to realize a plurality of different light emission patterns by applying a set of preprogrammed control parameters of the controllable light emitting elements.

9. The lighting system according to claim 1, such that in use the light sensor measures prescribed light emission angle ranges and the controller compares these with requested light emission angle ranges.

10. The lighting system according to claim 9, wherein the light sensor is adapted to sense the light that has been emitted from the spreading optical element and reflected back to the light sensor and the light emitting elements are electrically and mechanically integrated in a lighting unit.

11. A lighting system according to claim 9, wherein the indicator is adapted to transmit light information, and wherein the light sensor is adapted to sense the light information transmitted to the light sensor, and transmit this transmitted light information to the controller, the controller being adapted to link the transmitted light information into one light emission pattern.

12. A lighting system according to claim 1, wherein the spreading optical element is a negative or positive lens, a negative or positive Fresnel lens, or a patterned array of micro-prismatic beam deflectors.

13. A lighting system comprising:

a plurality of controllable light emitting elements, a spreading optical element arranged in front of the plurality of light emitting elements to shape the light emitted from the lighting elements and defining an available angular emission range of light emitted from the spreading optical element, and a controller having a processor and a memory with instructions for controlling drive signals of each of the plurality of controllable light emitting elements, wherein the controller is adapted to vary an angular output subrange of the available angular emission range of light emitted from the spreading optical element onto an illuminated surface by selecting the specific light emitting elements to create a both a first output subrange modified to a second angular output subrange different from the first angular output subrange;

an indicator device operable to indicate a desired light pattern on the illuminated surface in coded light;

a sensor operable to detect the indicated desired light pattern in coded light form the indicator device;

the controller operable to adapt the light emitted from the lighting elements to the second output subrange.

14. A lighting system comprising:

a plurality of controllable light emitting elements, a spreading optical element arranged in front of the plurality of light emitting elements to shape the light emitted from the lighting elements and defining an available angular emission range of light emitted from the spreading optical element, and a controller having a processor and a memory with instructions for controlling drive signals of each of the plurality of controllable light emitting elements, wherein the controller is adapted to vary an angular output subrange of the available angular emission range of light emitted from the spreading optical element by emitting light from a cluster of light emitting elements, each of the light emitting elements of the cluster of light emitting elements being collimated;

an indicator device operable by a user to output a coded light which indicates a desired light output light shape from the light emitting elements;

a coded light sensor operable to sense reflected light from the indicator device from an illuminated surface.

* * * * *